US010550645B1

(12) United States Patent
Ware et al.

(10) Patent No.: US 10,550,645 B1
(45) Date of Patent: Feb. 4, 2020

(54) DRILLING PLATFORM FOR CELLAR-TYPE WELL SITES

(71) Applicant: St. Peter Metal Works, LLC, Whitney, TX (US)

(72) Inventors: Joseph Ware, Kopperl, TX (US); Thomas St. Peter, Morgan, TX (US)

(73) Assignee: St. Peter Metal Works, LLC, Whitney, TX (US)

( * ) Notice: Subject to any disclaimer, the term of this patent is extended or adjusted under 35 U.S.C. 154(b) by 0 days.

(21) Appl. No.: 15/825,162

(22) Filed: Nov. 29, 2017

(51) Int. Cl.
*E21B 15/00* (2006.01)

(52) U.S. Cl.
CPC ..... *E21B 15/003* (2013.01)

(58) Field of Classification Search
CPC ..... E21B 15/00; E21B 15/003
See application file for complete search history.

(56) References Cited

U.S. PATENT DOCUMENTS 4,201,022 A * 5/1980 Jennings ..... B62D 55/0842 52/116
7,637,692 B1 12/2009 Rose
2015/0083888 A1* 3/2015 Krawchuk ..... E21B 15/00 248/678

* cited by examiner

*Primary Examiner* — Kristyn A Hall
(74) *Attorney, Agent, or Firm* — James E. Walton

(57) ABSTRACT

A system and method for enabling drilling equipment to access and work with well heads located in a cellar type arrangement. Modules are combined together with wheel risers to form various shaped platforms for spanning across the roof of cellars for hydrocarbon extraction. The various shaped platforms provide support adjacent the well head for work over rigs and surface rigs to drive adjacent the well heads located in the cellar.

7 Claims, 9 Drawing Sheets

DRILLING PLATFORM FOR CELLAR-TYPE WELL SITES

BACKGROUND

1. Field of the Invention

The present invention relates generally to platforms for oil wells, and more specifically to drilling well platforms for well-site having Cellar Tech containment cellars.

2. Description of Related Art

Conventional well sites for hydrocarbon extraction from the ground are flush with or above ground. In order to prevent accidents, some drill sites locate the well head below grade to prevent accidents. Well heads below grade are grouped together in a rectangular cellar below the pad site. Conventional systems for interacting with well heads in a cellar are hampered by the limited access and the requirement to work adjacent an open pit or cellar. Cellar tech containment well cellars are typically open pits having inwardly facing lips. Thus, there exists significant room for improvement in the art for overcoming these and other shortcomings of conventional systems and methods for platforms over cellars for oil field operations.

DESCRIPTION OF THE DRAWINGS

The novel features believed a characteristic of the embodiments of the present application is set forth in the appended claims. However, the embodiments themselves, as well as a preferred mode of use, and further objectives and advantages thereof will best be understood by reference to the following detailed description when read in conjunction with the accompanying drawings, wherein:

Figure 1:
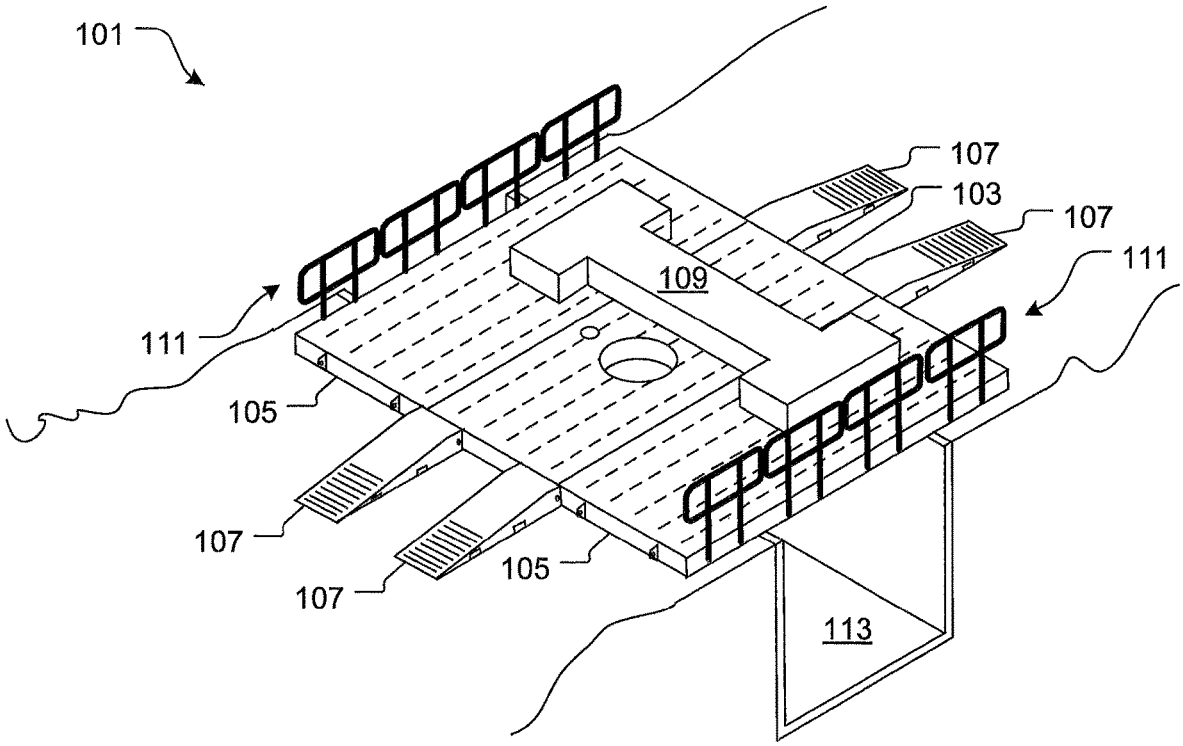
FIG. 1 is a perspective view of a well-site cellar partially covered with a surface rig platform according to the present application.

While the assembly and method of the present application are susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the drilling platforms for well-site cellars are provided below. It will, of course, be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
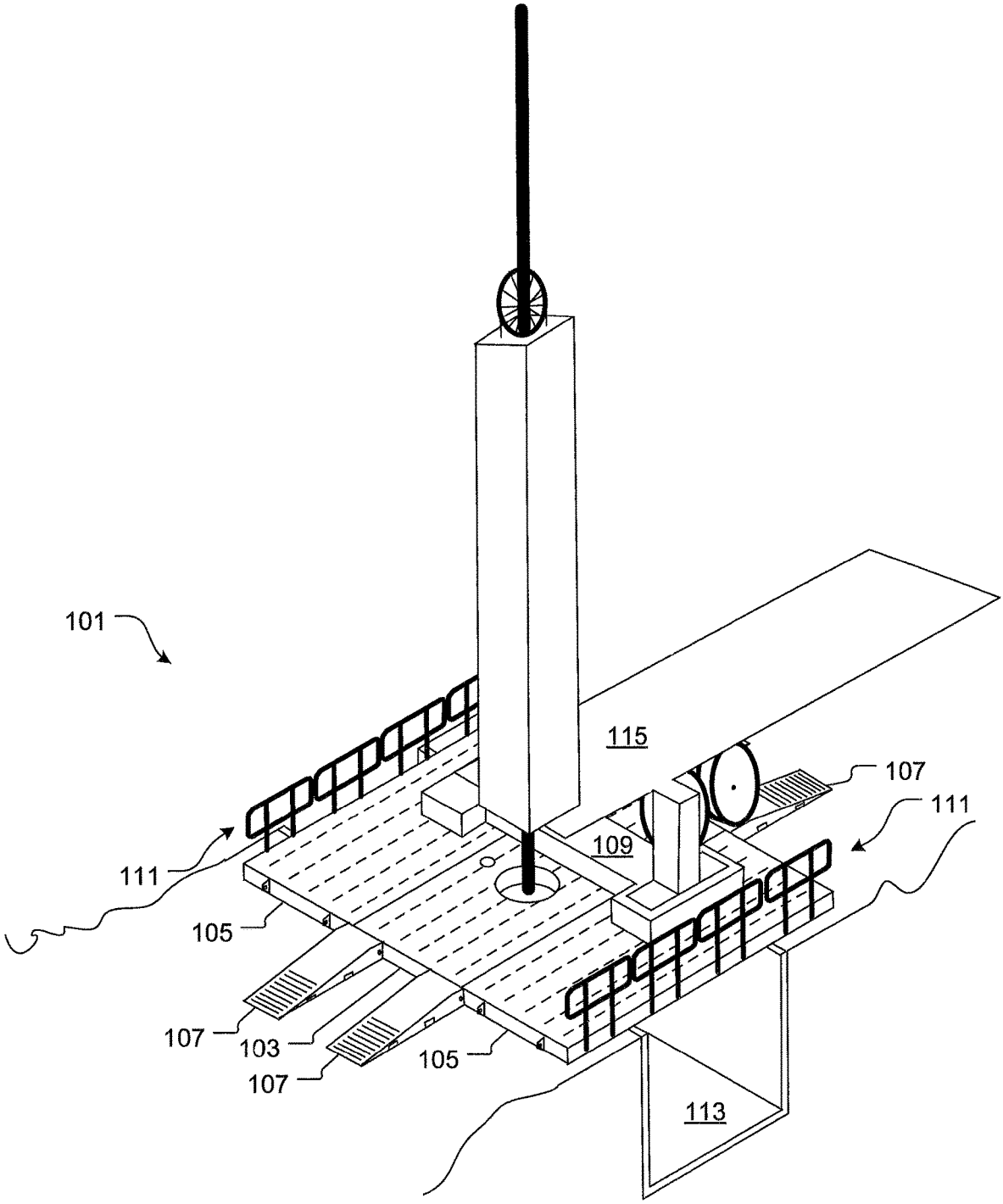
FIG. 2 is a perspective view of a well-site cellar partially covered with a surface rig platform having a surface rig on the surface rig platform according to the present application.

Referring now to FIGS. 1 and 2 in the drawings, a preferred embodiment of a surface rig platform according to the present application is illustrated. Surface rig platform system 101 is comprised of a central platform 103, a pair of side platforms 105, at least a pair of wheel risers 107, and a box beam 109. Furthermore, surface rig platform system 101 comprises a plurality of removable guardrails 111. Surface rig platform system 101 spans across cellar 113 and in configured to support drilling vehicle, such as surface rigs, on an upper surface of the surface rig platform system 101. Cellar 113 is preferably a Cellar Tech containment well cellar having an inwardly facing lip located near the opening of the cellar. Without the surface rig platform system 101 vehicles would be limited in proximity to a well head located in the cellar 113 depended upon the dimensions of the cellar. The surface rig platform system 101 allows a surface rig 115 or spud rig to back adjacent to the well head and be located over the well head. Preferably each open end of the surface rig platform system 101 utilizes the pair of wheel risers 107 to allow a vehicle to cross the cellar 113 from either end or cross the cellar. Side platforms 105 are rigidly coupled to the central platforms by their gusseted corners being bolted together through openings in each gusseted corner.

Figures 3A, 3B, 3C:
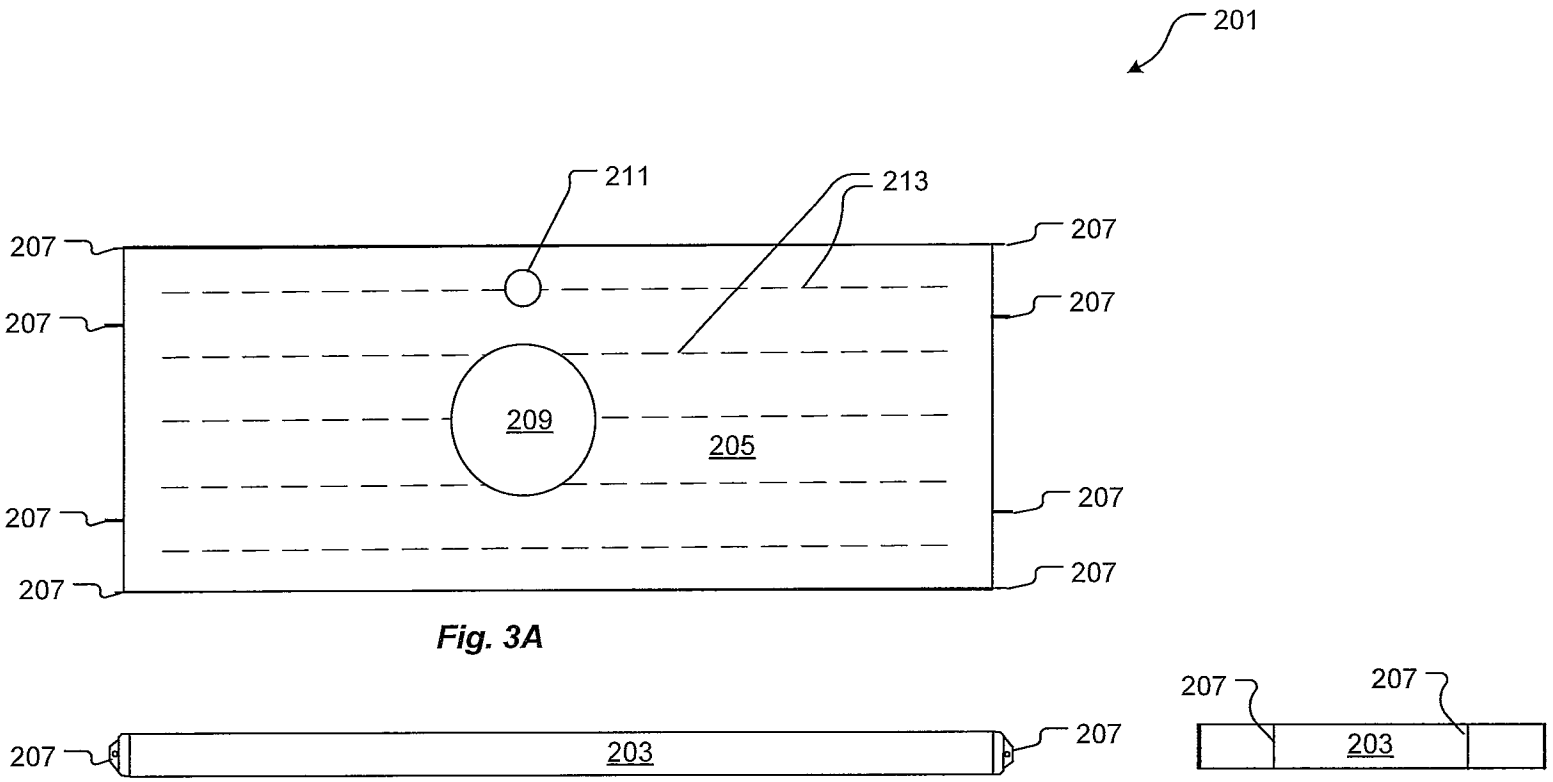
FIG. 3A is a top view of a central platform module for a surface rig platform according to the present application.
FIG. 3B is a side view of a central platform module for a surface rig platform according to the present application.
FIG. 3C is an end view of a central platform module for a surface rig platform according to the present application.

Referring now also to FIGS. 3A-3C in the drawings, a preferred embodiment of a central platform according to the present application is illustrated. Central platform 201 is similar to central platform 103. Central platform 201 is comprised of a frame 203, an upper plate 205, and a plurality of gussets 207 attached to the frame. Central platform 201 is preferably comprised of steel elements from the frame 203, to the upper plate 205, and the gussets 207. Upper plate 205 is preferably perforated (see perforations 213) across the entire plate to facility migration of fluid and gas from above and below the platform. Upper plate 205 utilizes a first opening 209 and a second opening 211. First opening 209 is located typically in the center of the upper plate and has a diameter sufficient to allow the surface rig to access the well head located directly below the first opening and drill through the central platform. Second opening 211 is located between the first opening 209 and a longitudinal side of the central platform. Second opening is configured to allow a conduit from the well head in the cellar to pass through the central platform.

Figure 4A:
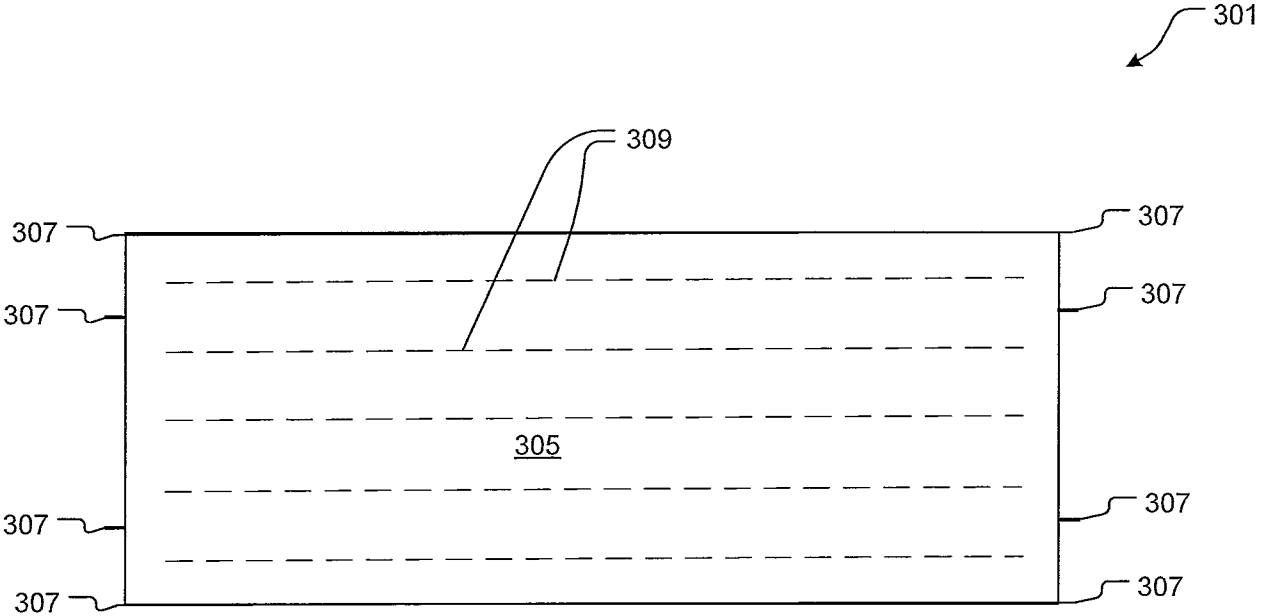
FIG. 4A is a top view of a side platform module for a surface rig platform according to the present application.
Figure 4B:
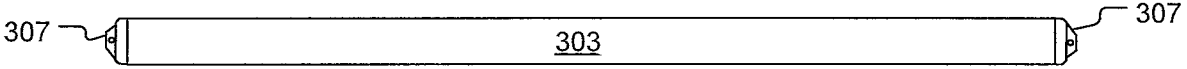
FIG. 4B is a side view of a side platform module for a surface rig platform according to the present application.
Figure 4C:
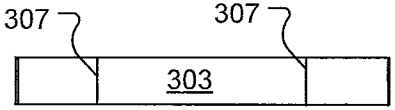
FIG. 4C is an end view of a side platform module for a surface rig platform according to the present application.

Referring now also to FIGS. 4A-4C in the drawings, a preferred embodiment of a side platform according to the present application is illustrated. Side platform 301 is similar to side platform 105. Side platform 301 is comprised of a frame 303, an upper plate 305, and a plurality of gussets 307 attached to the frame. Side platform 301 is preferably comprised of steel elements from the frame 303, to the upper plate 305, and the gussets 307. Upper plate 305 is preferably perforated (see perforations 309) across the entire plate to facilitate migration of fluid and gas from above and below the platform.

Figure 5A:
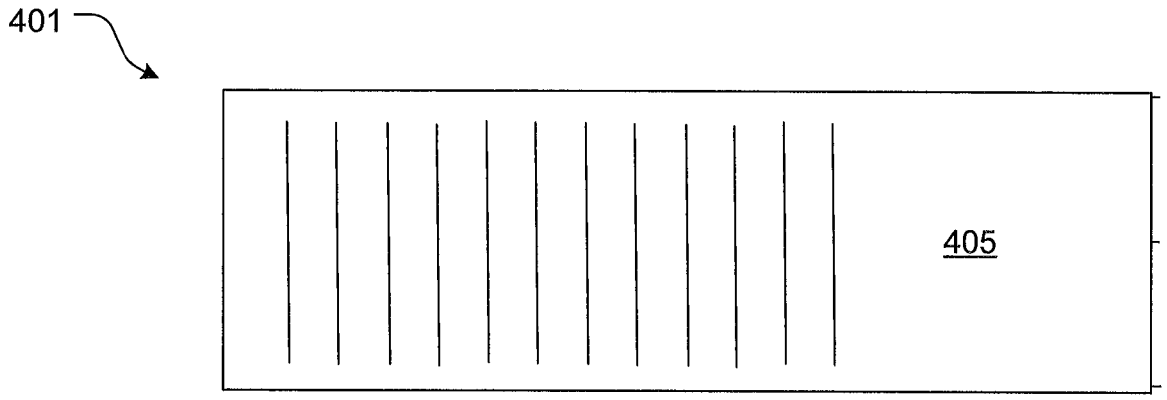
FIG. 5A is a top view of a wheel riser for a surface rig platform according to the present application.
Figure 5B:
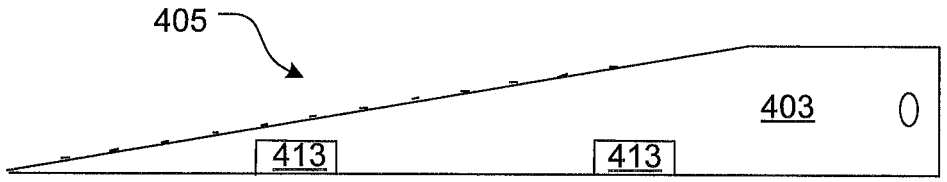
FIG. 5B is a side view of a wheel riser for a surface rig platform according to the present application.
Figure 5C:
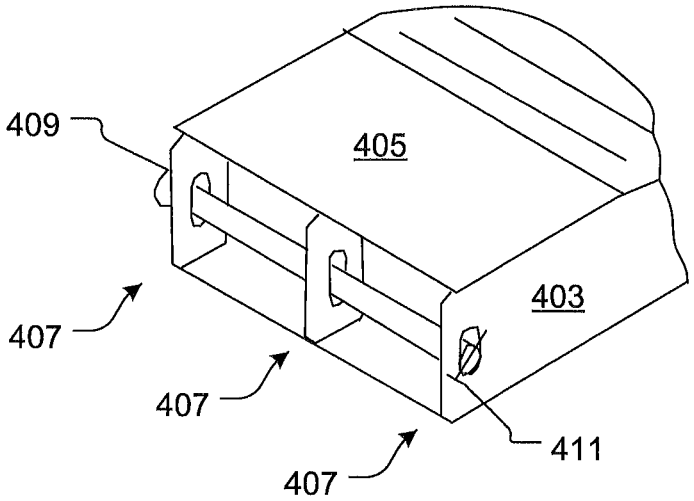
FIG. 5C is a detail view of a wheel riser for a surface rig platform according to the present application.

Referring now also to FIGS. 5A-5C in the drawings, a preferred embodiment of a wheel riser according to the present application is illustrated. Wheel riser 401 is similar to wheel riser 107. Wheel riser 401 is comprised of a frame 403, an upper plate 405, and a plurality of gussets 407 attached to the frame. Wheel riser 401 is preferably comprised of steel elements from the frame 403, to the upper plate 405, and the gussets 407. Upper plate 405 is preferably ribbed or textured across the entire plate to facility trailers and vehicle driving up and over wheel riser. Wheel riser 401 is configured to allow a wheeled vehicle drive from the surface of the base of the surface rig platform to the top of the surface rig platform. Rod 409 passes through the plurality of gussets 407 on the wheel riser 401 and engages the gussets 207 on the end of the central platform 103. Pin 411 secures rod 409 to wheel riser 401. Frame 403 preferably utilizes notches 413 in frame 403 to facilitate moving the steel wheel riser around the well site with a forklift.

Figure 6:
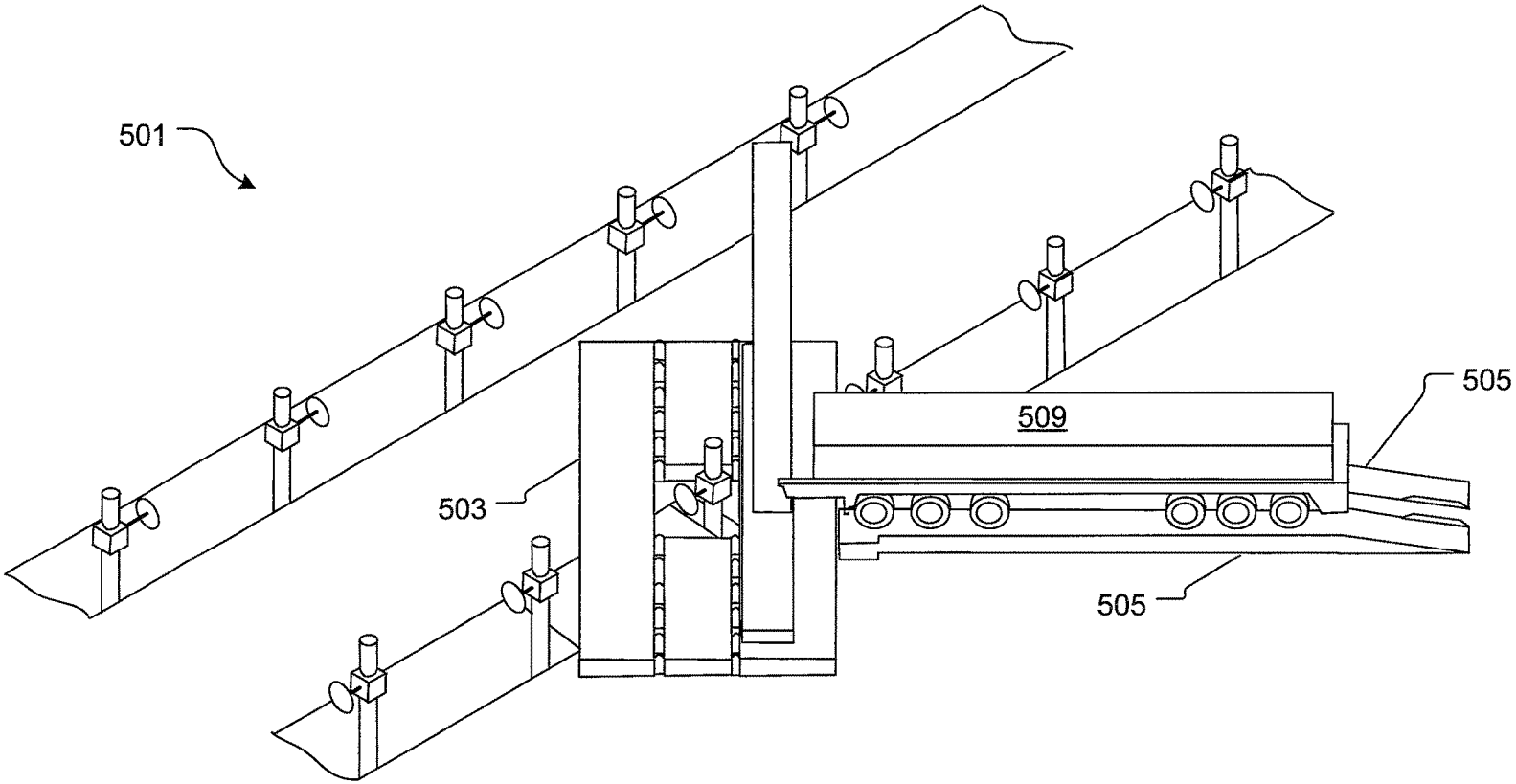
FIG. 6 is a perspective view of a well-site cellar partially covered with a workover rig platform according to the present application.
Figure 7:
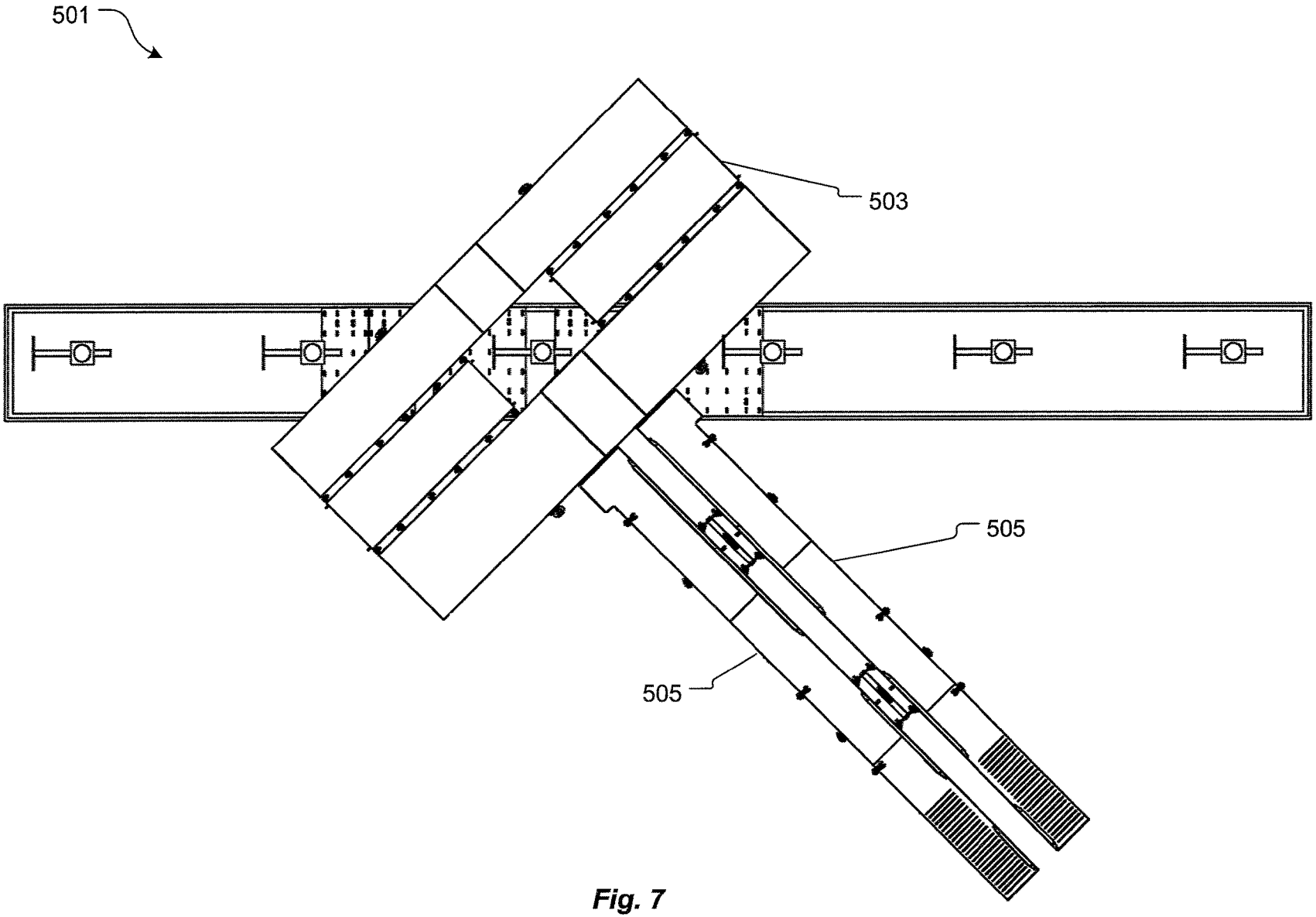
FIG. 7 is a top view of a well-site cellar partially covered with a workover rig platform according to the present application.
Figure 8D:
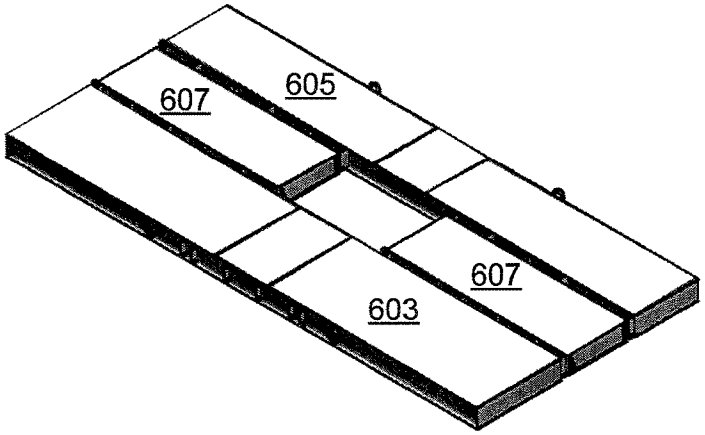
FIG. 8D is a perspective view of a workover rig platform according to the present application.
Figure 8C:
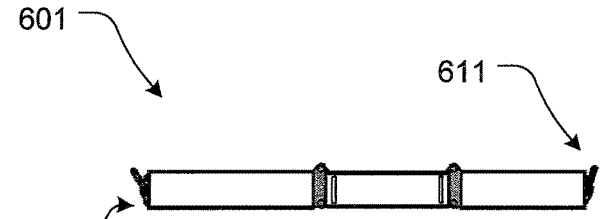
FIG. 8C is an end view of a workover rig platform according to the present application.
Figure 8A:
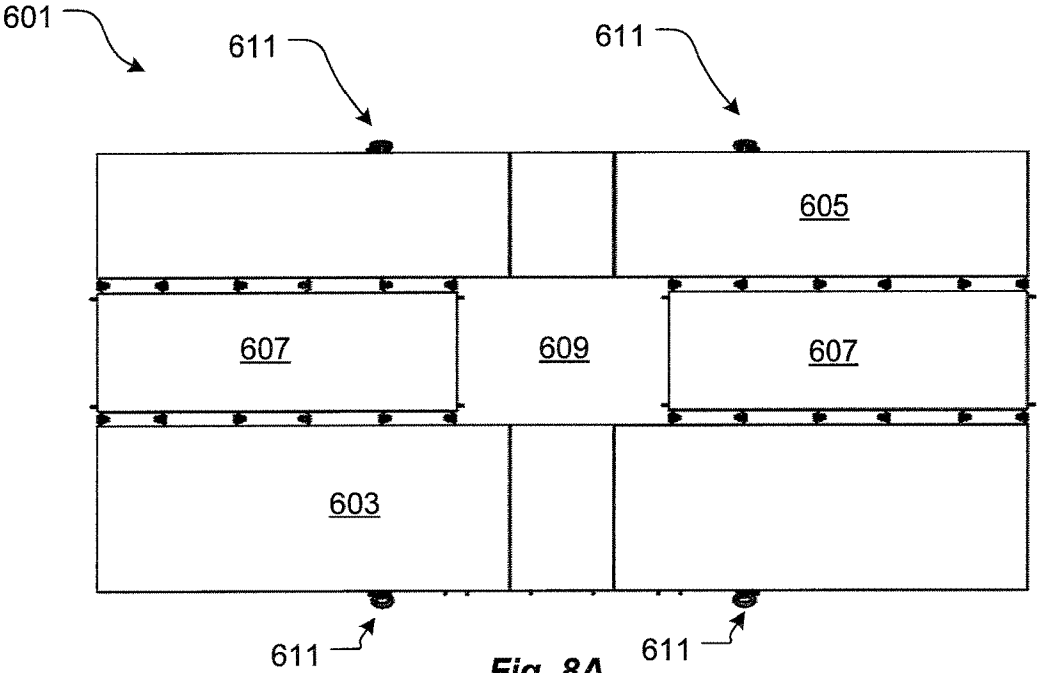
FIG. 8A is a top view of a workover rig platform according to the present application.
Figure 8B:
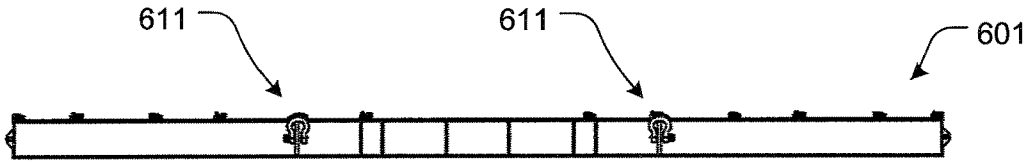
FIG. 8B is a side view of a workover rig platform according to the present application.
Figure 9D:
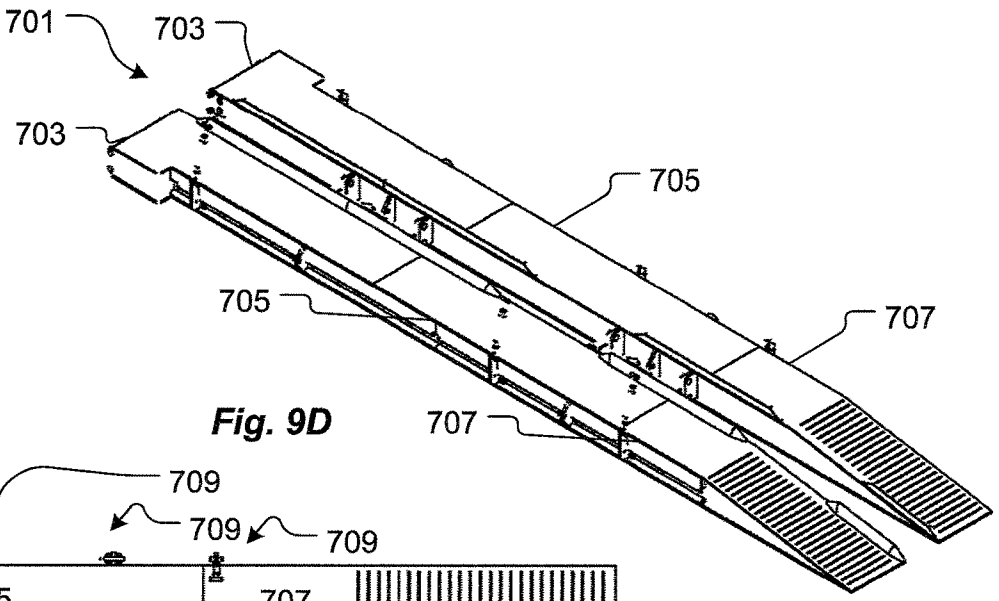
FIG. 9D is a perspective view of a wheel riser for a workover rig platform according to the present application.
Figure 9A:
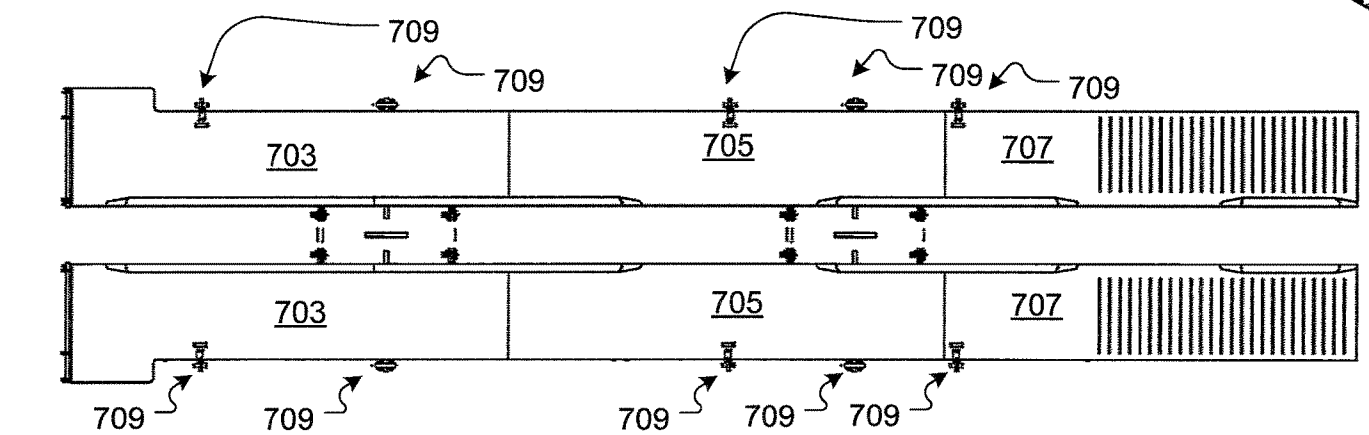
FIG. 9A is a top view of a wheel riser for a workover rig platform according to the present application.
Figure 9C:
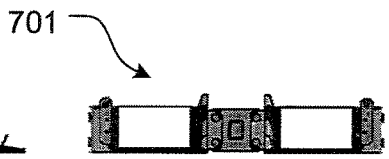
FIG. 9C is an end view of a wheel riser for a workover rig platform according to the present application.
Figure 9B:
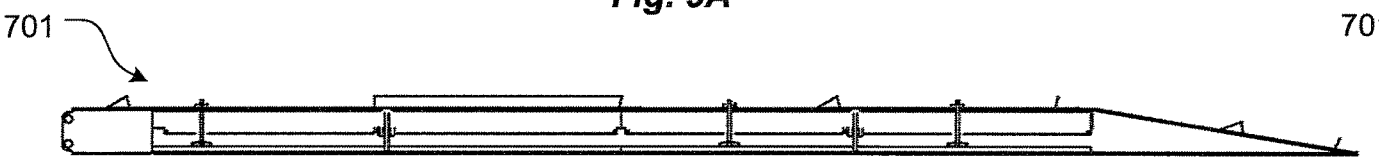
FIG. 9B is a side view of a wheel riser for a workover rig platform according to the present application.

Referring now also to FIGS. 6 and 7 in the drawings, a preferred embodiment of a workover rig platform according to the present application is illustrated. Workover rig platform system 501 is comprised of a main platform 503, and a pair of wheel risers 505. FIG. 6 illustrates a workover rig 509 located on the workover rig platform system 501, while FIG. 7 illustrates the workover rig platform system 501 without a workover rig 509. Workover rig platform 501 is configured to be moved in two pieces by moving the main platform 503 and the pair of wheel risers 505. Furthermore, each element of the workover rig platform 501 is less than 52 feet in length to facilitate transportation from one well site to another.

Wheel risers 505 are configured to positively retain the workover rig by strapping the workover rig down by turnbuckles with adjustable gusseted receivers. Workover rig platform is designed to be angled relative to a longitudinal axis of the cellar. By locating the workover rig platform access to all other well heads in the cellar is maintained.

Referring now also to FIGS. 8A-8D in the drawings, a preferred embodiment of a main platform according to the present application is illustrated. Main platform 601 is similar to main platform 503. Main platform 601 is comprised of a first platform 603, a second platform 605, and a pair of joining platforms 607. The first platform 603, the second platform 605, and the joining platforms 607 are preferably comprised of steel elements from the frame, to the upper plate, and the gussets connecting platforms to each other. Main platform utilizes an opening 609 located typically in the center of the main platform and has an opening sufficient to allow the workover rig to access the well head located directly below the first opening. Furthermore, main platform 601 features a plurality of lifting points 611 to allow a crane to lift and move the main platform relative to the cellar.

Referring now also to FIGS. 9A-9D in the drawings, a preferred embodiment of a pair of wheel risers 701 according to the present application is illustrated. Wheel riser 701 is similar to wheel riser 505. Wheel riser 701 is comprised of a first platform 703, a second platform 705, a ramp platform 707, and a plurality of rig attachment points 709. The first platform 703, the second platform 705, and the ramp platform 707 are preferably comprised of steel elements from the frame, to the upper plate, and the gussets connecting platforms to each other. Each of the wheel risers is coupled to the main platform to enable a workover rig to drive up the ramp platforms and across the first and second platforms and partially across the main platform. Wheel riser 701 is configured to have a length sufficient that the workover rig is supported on top of the main platform and the pair of wheel risers. Ramp platform 707 utilizes traction bars on the inclined surfaces.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments but are amenable to various changes and modifications without departing from the spirit thereof.

What is claimed is:

1. A modular platform for a well-site cellar, comprising:
- a central module;
- a first side module releasably coupled to a first edge of the central module;
- a second side module releasably coupled to a second edge of the central module opposite the first edge; and
- a pair of wheel risers coupled to the central module;
- wherein the central module, the first side module, and the second side module form a continuous planar surface along the full length of the central module along the first edge and second edge when assembled together.

2. The platform according to claim 1, further comprising:
- a pin configured to releasably attach the pair of wheel risers to the central module.

3. The platform according to claim 1, the central module comprising:
- a frame;
- an upper plate attached to the frame; and
- a first opening centrally located in the upper plate.

4. The platform according to claim 1, the central module further comprising:

a second opening located adjacent the first opening.

5. The platform according to claim 1, wherein the upper plate of the central module is perforated.

6. A modular platform for a well-site cellar, comprising:

a main platform;

a first wheel riser releasably coupled to the main platform via a coupling element; and a second wheel riser releasably coupled to the main platform via a coupling element;

wherein the first wheel riser comprises:

a first platform releasably coupled to the main platform, the first platform being level with the main platform;

wherein the first wheel riser and the second wheel riser are distinct and separate elements non-integral to the main platform and releasably and repeatably coupled to the main platform.

7. The platform according to claim 6, the first wheel riser further comprising:

a second platform releasably coupled to the first platform; and a ramp platform releasably coupled to the second platform.

* * * * *